US007731534B1

(12) United States Patent
Yuan et al.

(10) Patent No.: US 7,731,534 B1
(45) Date of Patent: Jun. 8, 2010

(54) ELECTRICAL CONNECTOR WITH IMPROVED BUCKLING TAB

(75) Inventors: Sheng-Tsung Yuan, Tu-Cheng (TW); Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/318,359

(22) Filed: Dec. 29, 2008

(51) Int. Cl.
*H01R 13/648* (2006.01)

(52) U.S. Cl. ..... 439/607.4; 439/607.55; 439/660

(58) Field of Classification Search ..... 439/530, 439/607.35–607.37, 607.4, 607.53–607.56, 439/309, 308, 607.01, 660
See application file for complete search history.

(56) References Cited

U.S. PATENT DOCUMENTS 5,637,015 A * 6/1997 Tan et al. ..... 439/607.37
5,738,544 A * 4/1998 Davis ..... 439/607.37
6,386,918 B1 * 5/2002 Zheng et al. ..... 439/607.45
6,682,368 B2 * 1/2004 Murr et al. ..... 439/607.28
2009/0042421 A1 * 2/2009 Zheng et al. ..... 439/83

* cited by examiner

*Primary Examiner*—Hae Moon Hyeon
(74) *Attorney, Agent, or Firm*—Rosenberg, Klein & Lee

(57) ABSTRACT

An electrical connector has an insulating housing defining a recess. A receiving plate extends frontward from a rear surface of the recess and spaced apart from a bottom surface thereof. A shell coupled with the insulating housing to form an insertion space where the receiving plate is located has a connecting plate located between the receiving plate and the bottom surface of the recess. A portion of the connecting plate is extended and curved upwards and then curved downwards and upwards sequentially to form a substantial split ring-shaped resilient element. The resilient element comprises an upper resistive portion located adjacent to the receiving plate and a lower resistive portion located adjacent to the bottom surface of the recess. A free end of the lower resistive portion extends obliquely upwardly to form a connecting portion. A distal end of the connecting portion forms a propping portion located above the connecting plate.

7 Claims, 3 Drawing Sheets

ELECTRICAL CONNECTOR WITH IMPROVED BUCKLING TAB

BACKGROUND OF THE INVENTION

1. Field of the Invention

The present invention generally relates to a connector, and more particularly to an electrical connector adapted for electrically connecting with a mating plug.

2. The Related Art

A portable electronic device is usually equipped with an electrical connector for electrically connecting with a mating plug, such as a universal serial bus (USB) plug. The conventional electrical connector generally involves an insulating housing, a plurality of terminals mounted in the insulating housing, and a shell coupled with the insulating housing to form an insertion chamber for receiving the USB plug. The shell, as well as we know, is often punched a plurality of buckling tabs. The buckling tabs extend into the insertion chamber to rest against the USB plug resiliently for making the USB plug connect with the terminals steadily. However, with frequent insertion and extraction operation of the USB plug, the resilience of the buckling tabs decreases gradually, which may affect the steady connection between the electrical connector and the USB plug so as to reduce usage life of the electrical connector.

SUMMARY OF THE INVENTION

An object of the present invention is to provide an electrical connector with a structure capable of fixing an inserted mating plug firmly for a long time. The electrical connector has an insulating housing defining a recess. A receiving plate is extended frontward from a rear surface of the recess and spaced apart from a bottom surface thereof. A plurality of terminals are received in the receiving plate. A shell is coupled with the insulating housing to form an insertion space where the receiving plate is located for allowing the mating plug to insert therein and receive the receiving plate. The shell has a connecting plate located between the receiving plate and the bottom surface of the recess. A portion of the connecting plate is extended and curved upwards and then curved downwards and upwards sequentially to form a substantial split ring-shaped resilient element. The resilient element comprises an upper resistive portion extended from the connecting plate and located adjacent to the receiving plate and a lower resistive portion opposite to the upper resistive portion and located adjacent to the bottom surface of the recess. A free end of the lower resistive portion extends obliquely upwardly to form a connecting portion. A distal end of the connecting portion forms a propping portion located above the connecting plate. When the mating plug is inserted, one of the upper resistive portion and the propping portion resists the mating plug firstly to make the other thereof uplift under the lower resistive portion resisting the bottom surface of the recess, and then the other thereof begins to resist the mating plug to do a reaction to the one thereof.

As described above, the electrical connector has the upper resistive portion and the propping portion, which are both against the inserted mating plug. Furthermore, the upper resistive portion makes the propping portion uplift when the upper resistive portion is pressed downwardly, and the propping portion is also enable to raise the upper resistive portion when the propping portion is pressed downwardly, accordingly, which not only enhances the insertion and withdrawal force between the electrical connector and the mating plug, but also prolongs usage life of the electrical connector.

BRIEF DESCRIPTION OF THE DRAWINGS

The present invention will be apparent to those skilled in the art by reading the following description, with reference to the accompanying drawings, in which.

DETAILED DESCRIPTION OF THE PREFERRED EMBODIMENT

Figure 1:
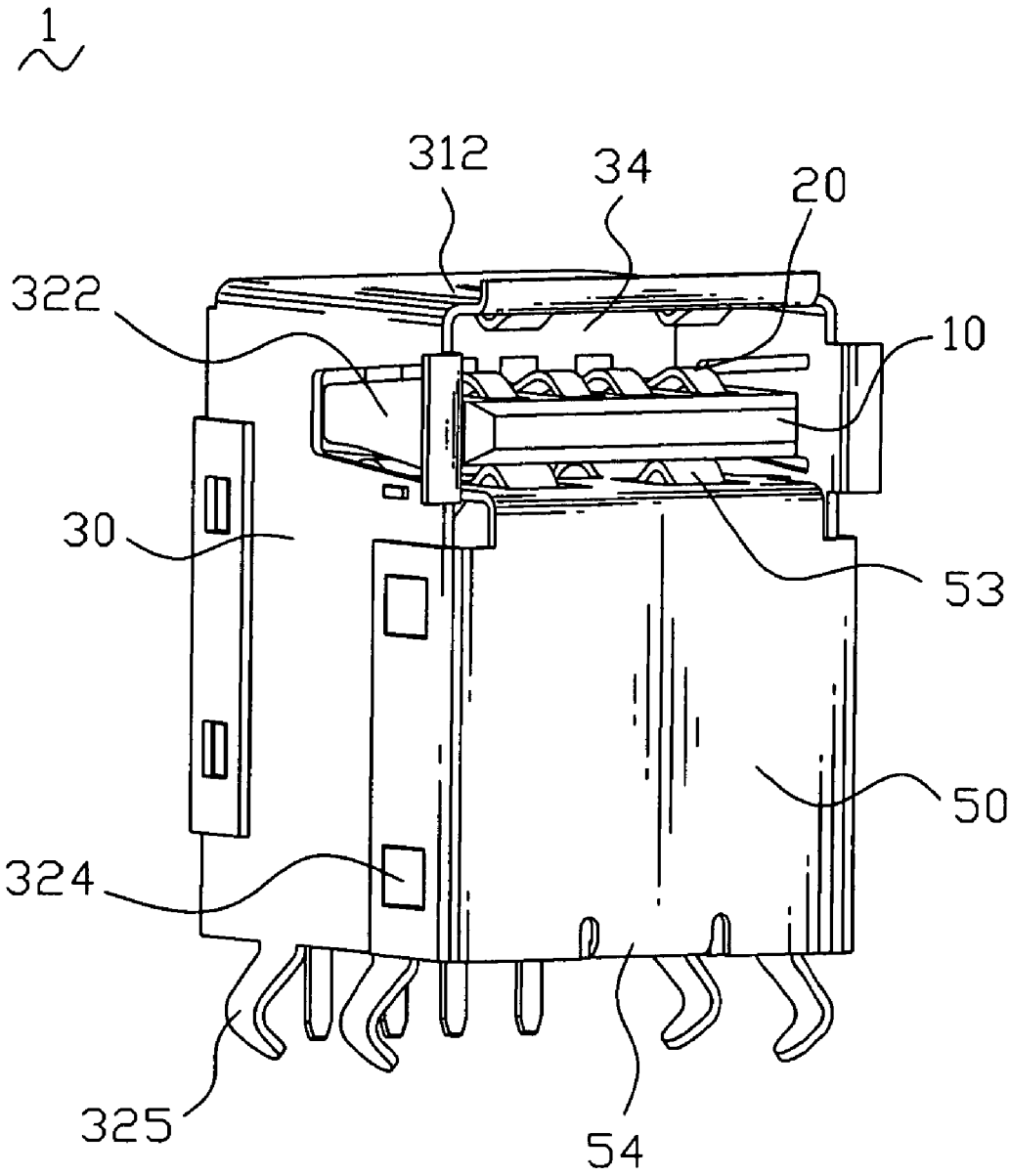
FIG. 1 is an assembled, perspective view of an electrical connector of an embodiment in accordance with the present invention.
Figure 2:
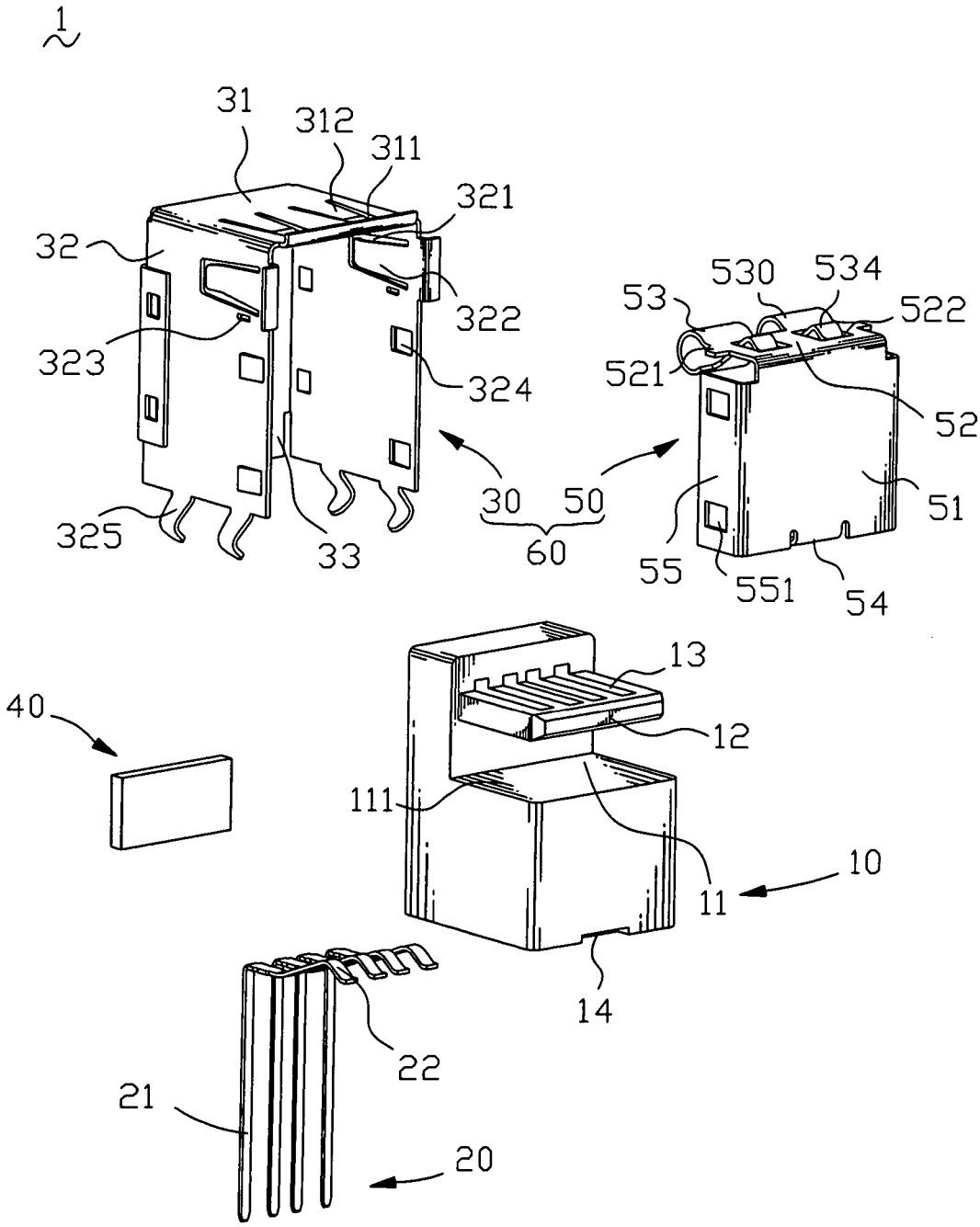
FIG. 2 is an exploded, perspective view of the electrical connector shown in FIG. 1.

With reference to FIG. 1 and FIG. 2, an electrical connector 1 of an embodiment according to the present invention is shown. The electrical connector 1 includes an insulating housing 10 of rectangular shape, a plurality of terminals 20 and a shell 60 coupled with the insulating housing 10.

Figure 3:
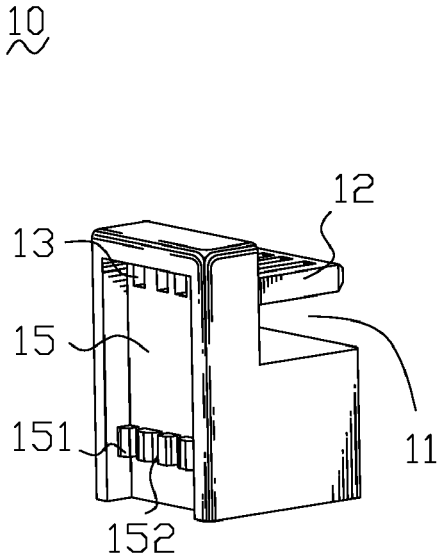
FIG. 3 is a perspective view of an insulating housing of the electrical connector shown in FIG. 2 seen from another angle.
Figure 4:
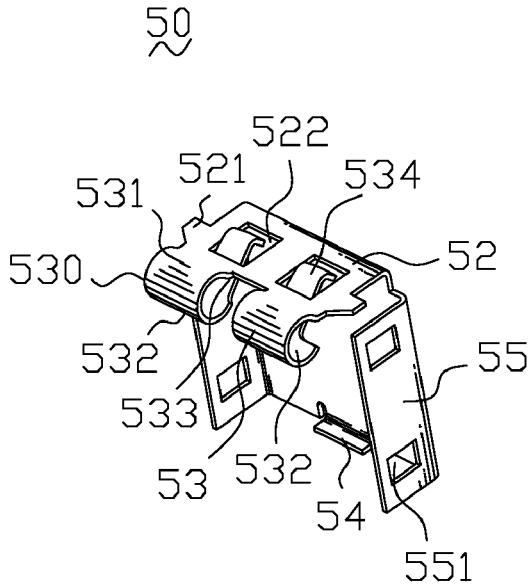
FIG. 4 is a perspective view of a second shell of the electrical connector shown in FIG. 2 seen from another angle.

Please refer to FIG. 2 and FIG. 3, the insulating housing 10, defining a front end and a rear end opposite to the front end, has a recess 11 at an upper portion of the front end thereof. The recess 11 passes through a top surface and two opposite sides of the insulating housing 10, and defines a bottom surface 111. A rear surface of the recess 11 is protruded frontward to form a receiving plate 12, with a width thereof less than a width of the insulating housing 10. The receiving plate 12 has a plurality of terminal grooves 13 extending frontward and rearward and reaching a rear surface of the insulating housing 10 for receiving the terminals 20. The insulating housing 10 has a stopping cavity 14 at a bottom thereof, passing through a front surface thereof. The rear end of the insulating housing 10 is recessed frontward to form a receiving recess 15. The receiving recess 15 passes through the bottom of the insulating housing 10 and communicates with the terminal grooves 13. A lower portion of a bottom of the receiving recess 15 is protruded rearward to form a restraining portion 151. The restraining portion 151, extending transversely, has a plurality of restraining grooves 152 extending upwards and downwards, each of which is in alignment with the corresponding terminal groove 13.

Referring to FIGS. 1-3, the terminals 20 are respectively mounted in the terminal grooves 13 from the receiving recess 15. Each of the terminals 20 has a fixing portion 21 and a contacting portion 22 substantially perpendicular to the fixing portion 21. The fixing portion 21 is of strip shape and restrained in the restraining groove 152, with a distal end thereof exceeding the bottom of the insulating housing 10. The contacting portion 22 accommodated in the terminal groove 13 has a free end of arc shape over a top surface of the receiving plate 12.

Referring to FIGS. 1, 2, 4 and 5, the shell 60 includes a first shell 30 and a second shell 50. The first shell 30 has a covering plate 31 of rectangular shape, two lateral plates 32 extending downwardly from two opposite edges of the covering plate 31 and a blocking plate 33 extending downwardly from a rear edge of the covering plate 31 and connected with the two lateral plates 32, assembled to the insulating housing 10 from a rear direction to form an insertion space 34 where the receiving plate 12 is located. The covering plate 31 has two rectangular apertures 311 disposed abreast. A rear edge of each of the apertures 311 is extended frontward to form a resistive tab 312, with an arc-shaped distal end thereof inserted into the insertion space 34 for abutting a USB plug (not shown). The lateral plate 32 also has a rectangular aperture 321 and a resistive tab 322, which are respectively similar to the aperture 311 and the resistive tab 312, at an upper portion thereof for abutting the inserted USB plug. A small slot 323 is formed adjacent to the aperture 321. A front end of the lateral plate 32 is punched outwards to form two fixing pieces 324 spaced away from each other. A bottom edge of the lateral plate 32 extends downwardly to form two installing portions 325. The installing portion 325 is curved to show an arc shape for fastening the electrical connector 1 to a printed circuit board (PCB).

The second shell 50 assembled to the insulating housing 10 from a front direction has a basic plate 51 of rectangular shape. The basic plate 51 has a bottom edge bent rearward to form a stopping piece 54 inserted into the stopping cavity 14 of the insulating housing 10 for fixing the second shell 50 to the insulating housing 10. Two opposite sides of the basic plate 51 are respectively curved rearwards to form a mating plate 55. The mating plate 55 has two fixing holes 551 corresponding to the corresponding fixing pieces 324 for securing the first shell 30 and the second shell 50. A top edge of the basic plate 51 is bent rearward to form a connecting plate 52 underlying the receiving plate 12 with a predetermined distance. The connecting plate 52 has two oblong holes 522, arranged side by side. Middles of both opposite sides of the connecting plate 52 respectively project outwards to form a patch 521 corresponding to the slot 323 for fixing the first shell 30 and the second shell 50. A rear edge of the connecting plate 52 is connected with two buckling components 53.

The buckling component 53 has a resilient element 530 extended upwards from the rear edge of the connecting plate 52, and then curved downwards and upwards sequentially. The resilient element 530 is substantially a split ring shape, and defines an upper resistive portion 531 of arc shape adjacent to the receiving plate 12 and a lower resistive portion 532 of arc shape disposed below the upper resistive portion 531 and spaced away from the bottom surface 111. The buckling component 53 further has a connecting portion 533 extending obliquely upwardly towards the corresponding hole 522 from a free end of the lower resistive portion 532. A distal end of the connecting portion 533 is curved downwards to form a propping portion 534 of arc shape. The propping portion 534 passes through the hole 522 and exceeds the connecting plate 52.

Figure 5:
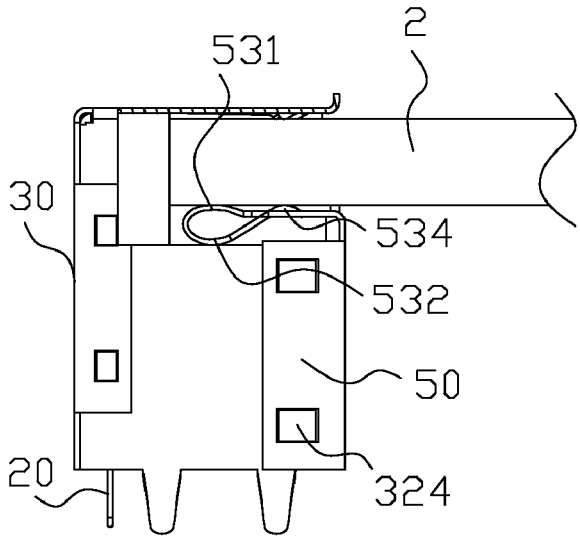
FIG. 5 is a schematic view illustrating a mating state of a buckling component of the electrical connector shown in FIG. 2 resting against an inserted USB plug.

Please refer to FIGS. 1-2 and FIG. 5, in assembly, the contacting portions 22 of the terminals 20 are respectively inserted into the corresponding terminal grooves 13, and the fixing portions 21 are respectively placed in the restraining grooves 152. The first shell 30 and the second shell 50 are coupled with the insulating housing 10 from the rear direction and the front direction, respectively. The patches 521 are inserted into the corresponding slots 323, and the fixing holes 551 are respectively mated with the fixing pieces 324 for fixing the first shell 30 and the second shell 50 together. In this embodiment, a partition plate 40 is provided to be disposed between the restraining portion 151 and the blocking plate 33 for fixing the terminals 20.

When a USB plug 2 is partly inserted into the electrical connector 1 to press the propping portion 534 of the buckling component 53 downwardly, the upper resistive portion 531 is raised. When the USB plug 2 is continuously pushed into the insertion space 34, the upper resistive portion 531 is pressed downwardly to do a reaction to the propping portion 534, namely, making the propping portion 534 move upward. At this time, the lower resistive portion 532 resiliently leans on the bottom surface 111 for supporting the upper resistive portion 531 and the propping portion 534. In addition, the resistive tabs 312, 322 are all against the USB plug 2 for fixing the USB plug 2.

As described above, the buckling component 53 of the electrical connector 1 has the upper resistive portion 531 and the propping portion 534, which are both against the inserted USB plug 2. The upper resistive portion 531 makes the propping portion 534 uplift when the upper resistive portion 531 is pressed downwardly, and the propping portion 534 is also enable to raise the upper resistive portion 531 when the propping portion 534 is pressed downwardly. Furthermore, the upper resistive portion 531 and the lower resistive portion 532 constitute jointly the resilient element 530 of substantially split-ring shape. Therefore, the buckling component 53 which not only enhances the insertion and withdrawal force between the electrical connector 1 and the USB plug 2, but also prolongs usage life of the electrical connector 1.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector adapted for electrically connecting with a mating plug, comprising:

an insulating housing defining a recess, a receiving plate extending frontwardly from a rear surface of the recess and spaced apart from a bottom surface thereof;

a plurality of terminals received in the receiving plate; and a shell coupled with the insulating housing to form an insertion space where the receiving plate is located for allowing the mating plug to insert therein and receive the receiving plate, the shell having a connecting plate located between the receiving plate and the bottom surface of the recess, a portion of the connecting plate being extended and curved upwards and then curved downwards and upwards sequentially to form a substantial split ring-shaped resilient element, the resilient element comprising an upper resistive portion extended from the connecting plate and located adjacent to the receiving plate and a lower resistive portion opposite to the upper resistive portion and located adjacent to the bottom surface of the recess, a free end of the lower resistive portion extending obliquely upwardly to form a connecting portion, a distal end of the connecting portion forming a propping portion located above the connecting plate, wherein when the mating plug is inserted, one of the upper resistive portion and the propping portion resist the mating plug firstly to make the other thereof uplift under the lower resistive portion resisting the bottom surface of the recess, and then the other thereof begins to resist the mating plug due to a reaction to the one thereof.

2. The electrical connector as claimed in claim 1, wherein the recess is formed at an upper portion of the insulating housing and passes through a top and two opposite sides of the insulating housing, the shell has a first shell coupled with the insulating housing from a direction opposite to an insertion direction to form the insertion space and a second shell mated with the insulating housing along the insertion direction and connected with the first shell, the second shell has a basic plate of which a top bent towards the insertion space to form the connecting plate.

3. The electrical connector as claimed in claim 2, wherein the first shell has a covering plate suspended over the receiving plate and a pair of lateral plates extending downwards from two opposite sides of the covering plate, each of which is punched inwards to form a resistive tab for resisting the inserted mating plug.

4. The electrical connector as claimed in claim 1, wherein the propping portion passes through a hole formed on the connecting plate for resting against the mating plug.

5. An electrical connector adapted for electrically connecting with a mating object, comprising:

an insulating housing defining a recess for receiving the mating object; and a connecting plate located in a lower portion of the recess and spaced from a bottom surface of the recess, a portion of the connecting plate being extended and curved upwards and then curved downwards and upwards sequentially to form a substantial split ring-shaped resilient element, the resilient element comprising an upper resistive portion at a top thereof and a lower resistive portion opposite to the upper resistive portion and located adjacent to the bottom surface of the recess, a free end of the lower resistive portion extending obliquely upwardly to form a connecting portion, a distal end of the connecting portion forming a propping portion located above the connecting plate, wherein when the mating object is inserted, one of the upper resistive portion and the propping portion resists the mating plug firstly to make the other thereof uplift under the lower resistive portion resisting the bottom surface of the recess, and then the other thereof begins to resist the mating object due to a reaction to the one thereof.

6. The electrical connector as claimed in claim 5, further comprising a shell having a covering plate, said shell being engaged with the insulating housing and said covering plate being located at an upper portion of the recess and disposed over the connecting plate, a portion of the covering plate extending towards the connecting plate to form a resistive tab for resisting the inserted mating object.

7. The electrical connector as claimed in claim 5, wherein the propping portion passes through a hole formed on the connecting plate for resting against the mating object.

* * * * *